US005454732A

United States Patent [19]

Denovich et al.

[11] Patent Number: 5,454,732

[45] Date of Patent: Oct. 3, 1995

[54] SEALED ELECTRICAL CONNECTOR PROVIDING INSULATION DISPLACEMENT WIRE TERMINATION

[75] Inventors: Sam Denovich, Harrisburg; James W. Robertson, Oberlin; Thomas J. Schuetz, Mechanicsburg, all of Pa.

[73] Assignee: The Whitaker Corporation, Wilmington, Del.

[21] Appl. No.: 367,907

[22] Filed: Jan. 3, 1995

Related U.S. Application Data

[63] Continuation of Ser. No. 955,535, Oct. 1, 1992, abandoned.

[51] Int. Cl.[6] ..... H01R 13/52

[52] U.S. Cl. ..... 439/523; 439/271; 439/936

[58] Field of Search ..... 439/271–283, 439/395–404, 409–413, 417–419, 709, 936, 523

[56] References Cited

U.S. PATENT DOCUMENTS

| | | | |
|---|---|---|---|
| 708,405 | 5/1903 | Robertson et al. . | |
| 749,373 | 8/1904 | Koblitz et al. . | |
| 773,069 | 10/1904 | Robertson . | |
| 863,626 | 4/1908 | Capper et al. . | |
| 878,807 | 5/1908 | Koblitz et al. . | |
| 3,241,095 | 3/1966 | Phillips | 439/199 |
| 3,351,885 | 11/1967 | Baldwin et al. | 439/201 |
| 3,571,783 | 3/1971 | Zusk | 439/201 |
| 3,869,189 | 3/1975 | McCurdy | 439/426 |
| 4,192,569 | 3/1980 | Mucci | 439/201 |
| 4,637,675 | 1/1987 | Loose | 339/97 R |
| 4,705,340 | 11/1987 | Loose | 439/395 |
| 4,795,364 | 1/1989 | Frantum, Jr. et al. | 439/407 |
| 5,006,077 | 4/1991 | Loose et al. | 439/409 |
| 5,090,917 | 2/1992 | Noorily et al. | 439/936 |
| 5,120,245 | 6/1992 | Robertson et al. | 439/395 |

OTHER PUBLICATIONS

*AMP Catalog 82257*, "AMP Quiet Front Terminal Block", Sep. 1991; AMP Incorporated, Harrisburg, Pa.

*3M Brochure*, "Scotch™ Polyurethane Protective Tape", (date unknown); 3M Industrial Specialties Division, St. Paul, Minn.

*Primary Examiner*—David L. Pirlot

*Attorney, Agent, or Firm*—Anton P. Ness

[57] ABSTRACT

An electrical connector 10 having a housing 12 containing a terminal 30 of the type adapted for insertion of an end of a wire 40,42 through a wire-receiving aperture 14,16 thereof for termination, includes a substrate 50 adhered to the outer housing surface and traversing the wire-receiving aperture with a corresponding hole 52,54 aligned therewith to permit wire insertion. The substrate may be tough elastomeric tape, and the hole is smaller than the wire diameter to tightly grip the wire insulation after wire insertion to assuredly retain sealant material within the connector upon wire withdrawal.

3 Claims, 4 Drawing Sheets

SEALED ELECTRICAL CONNECTOR PROVIDING INSULATION DISPLACEMENT WIRE TERMINATION

This application is a Continuation of application Ser. No. 07/955,535 filed Oct. 1, 1992 now abandoned.

FIELD OF THE INVENTION

This invention relates to the field of electrical connectors and more particularly to electrical connectors adapted for termination of electrical conductors by insulation displacement and sealing the termination.

BACKGROUND OF THE INVENTION

Electrical connectors are known in which an electrical terminal is retained within a dielectric housing and is adapted for termination to an end of a conductor wire inserted through an aperture of the housing. Examples of such connectors are found in U.S. Pat. Nos. 4,637,675; 4,705,340; 4,795,364; 5,006,077; 5,120,245; and in U.S. patent application Ser. Nos. 07/708,405 filed May 31, 1991; 07/773,069 filed Oct. 7, 1991; 07/863,626 filed Apr. 3, 1992. Examples of products are disclosed in AMP Catalog No. 82257 entitled "AMP Quiet Front Terminal Block" dated September 1991.

Generally, such connectors disclose a multiterminal housing block having individual cylindrical housing sections each containing a barrel-shaped terminal having an aperture through a side wall for receipt of an insulated wire end aligned with a wire-receiving aperture through the housing wall, and a slot extending laterally from the aperture defined by metal edges spaced closely enough to slice into and thereby penetrate the insulative jacket of the wire upon rotation of the terminal within the housing section and slightly compressively engage the conductor wire therewithin, defining a termination. An actuator secured atop each housing section is rotatable to turn the barrel terminal upon insertion of the wire end thereinto. Commonly, such connectors can utilize a two-apertured terminal and corresponding housing section defining two such wire-receiving arrangements for receipt of two wire ends thereinto for respective terminations, and can be used to cross-connect the wires to each other as in Ser. No. 07/708,405, or to a third conductor also electrically connected to the terminal, as in U.S. Pat. No. 5,120,245.

The housing sections of such connectors preferably contain a sealant composition such as grease or synthetic gel-like compositions which coat the exposed metal surfaces to prevent moisture and air from causing corrosion, preserving the integrity of the electrical connection for long-term in-service use. In U.S. patent application Ser. Nos. 07/749,373 filed Aug. 23, 1991 and 07/878,807 filed May 5, 1992 there are disclosed electrical connectors which contain novel sealant compositions having a gel-like consistency. The sealant compositions are disclosed to conform and coat the otherwise exposed metal surfaces of the wire conductor and the terminal and thus seal the surfaces against corrosion. The unstripped ends of wires may be inserted into the respective apertures for termination, easily penetrating the sealant material to be seated in the apertures of the barrel terminals; the terminals are then easily rotated by the actuator to penetrate the insulation and establish an electrical connection with the wires. The sealant material embeds and coats all exposed metal within the housing to inhibit corrosion, maintaining protection of the termination for long in-service life.

From time to time repairs to such terminations may be necessary, such as where a wire has been damaged at a location remote from the termination. The damaged wire must be removed from the termination, by rotating the terminal to an open position and pulling the wire end from the connector. In such cases some amount of sealant material would remain adhered to the wire end and be somewhat messy. This would also diminish the amount of sealant material remaining in the connector, and for reuse of the connector a corresponding amount of material would have to be reinjected into the connector around the terminal to again assure sealing when a new wire end is reinserted to reestablish the termination.

Certain connectors such as those disclosed in Ser. Nos. 07/749,373 and 07/878,807 include tape elements are positioned onto the outer surface of the housing and covering the wire-receiving apertures of the housing sections, with holes or intersecting slots defined in the tape approximately aligned with the centers of the apertures. Such tape elements to a substantial degree retain the sealant material within the housing and are adapted to permit wire insertion.

It is known with some conventional sealant materials which are two-part compositions, for the two fluid parts of the sealant material to be thoroughly mixed just prior to injection into the connector housing, and thereafter curing after injection; conventionally, a continuous film or tape such as of cellophane has been used to close off the apertures of the housing at least until the fluid has cured, whereafter the substrate may be removed for entry of the wire ends through the housing apertures, or alternatively the substrate may be slit at the apertures for wires to be inserted therethrough.

It is desired to provide a sealant-retaining tape element which assures that all sealant material remains in the housing upon removal of a wire end during repair after initial termination.

SUMMARY OF THE INVENTION

The present invention provides a tape element of material which is durable and also elastomeric with a degree of toughness permitting stretching, such as polyurethane. The wire-receiving holes of the tape element are punched to have a diameter smaller than the nominal diameter of a standard wire to be inserted therethrough during termination. Upon insertion of a larger diameter wire, or a wire of square cross section dimensioned larger than the hole diameter, the periphery of the hole is elastically enlarged and remains tightly gripping the insulation of the wire thereafter. Upon any subsequent removal of the wire end, the tape tightly gripping the wire insulation strips off any sealant material tending to be withdrawn from the connector by adhering to the wire insulation surface.

It is an objective of the present invention to provide a sealant retaining tape element covering a wire-receiving aperture of a housing, which elastically tightly grips the outer surface of the wire at the wire exit to clean off any sealant material sticking to the wire during removal after termination, providing full retention of all sealant material in the connector eliminating the need to insert more thereinto for connector reuse, and also eliminate the untidy mess of sealant material outside the connector during servicing.

An embodiment of the invention will now be described by way of example with reference to the accompanying drawings.

DETAILED DESCRIPTION OF THE PREFERRED EMBODIMENT

Figure 1:
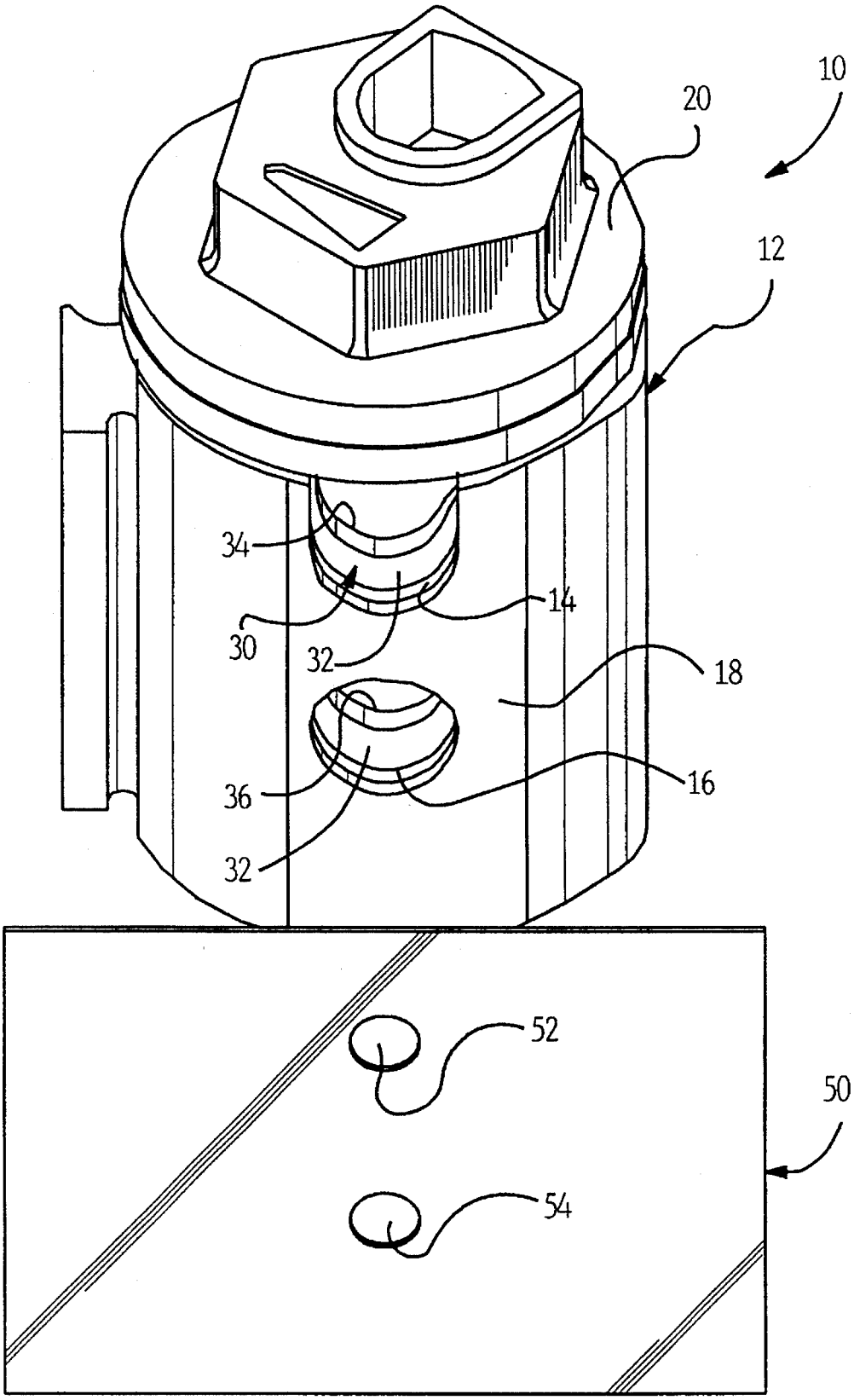
FIG. 1 is an isometric view of a connector having the tape element of the present invention positioned to be applied to an outer surface thereof to traverse wire-receiving openings thereof.
Figure 2:
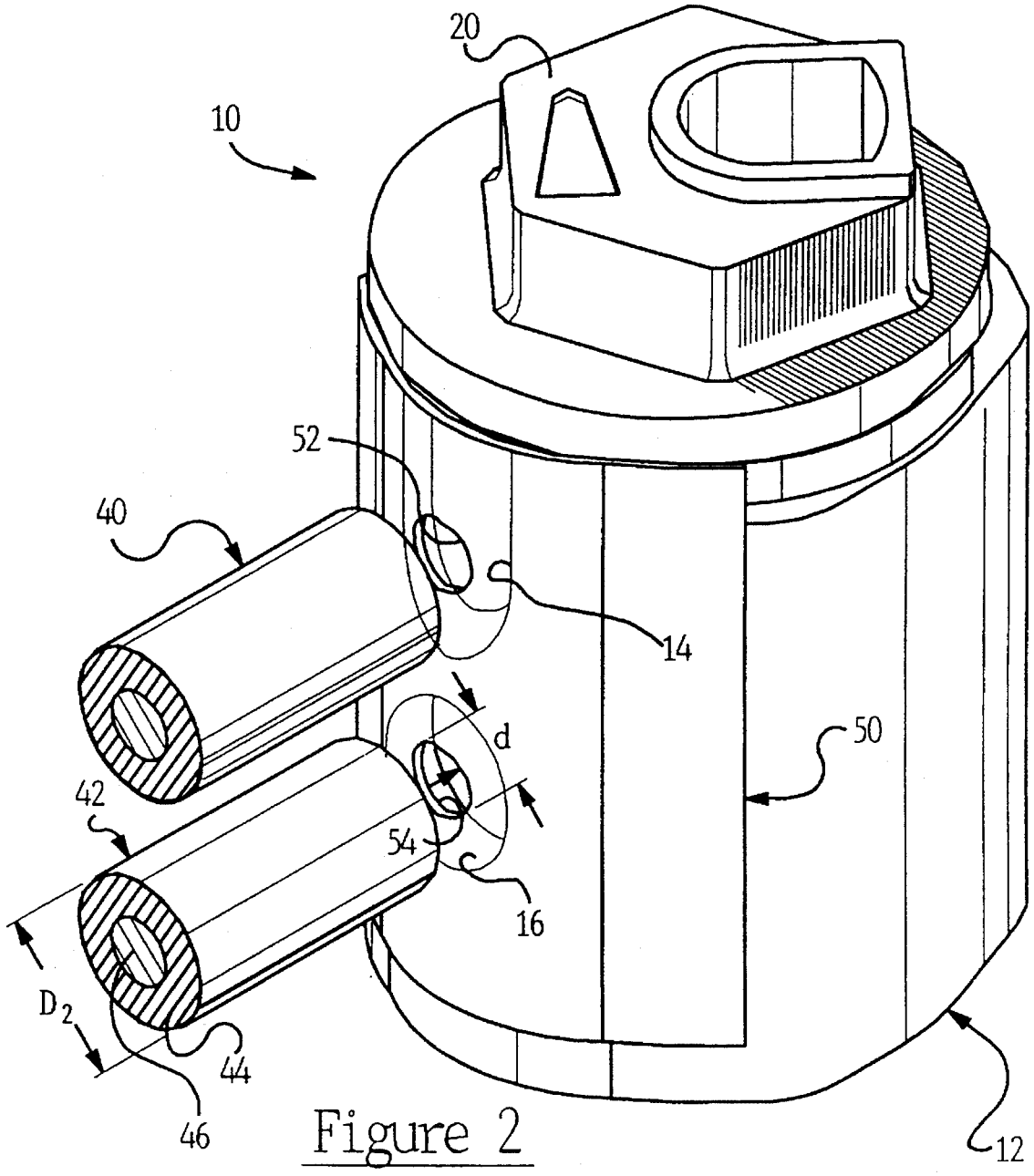
FIG. 2 is an isometric view of the connector of FIG. 1 with ends of a pair of large-diameter wires to be inserted through holes of the tape and into the wire-receiving openings of the connector.
Figure 3:
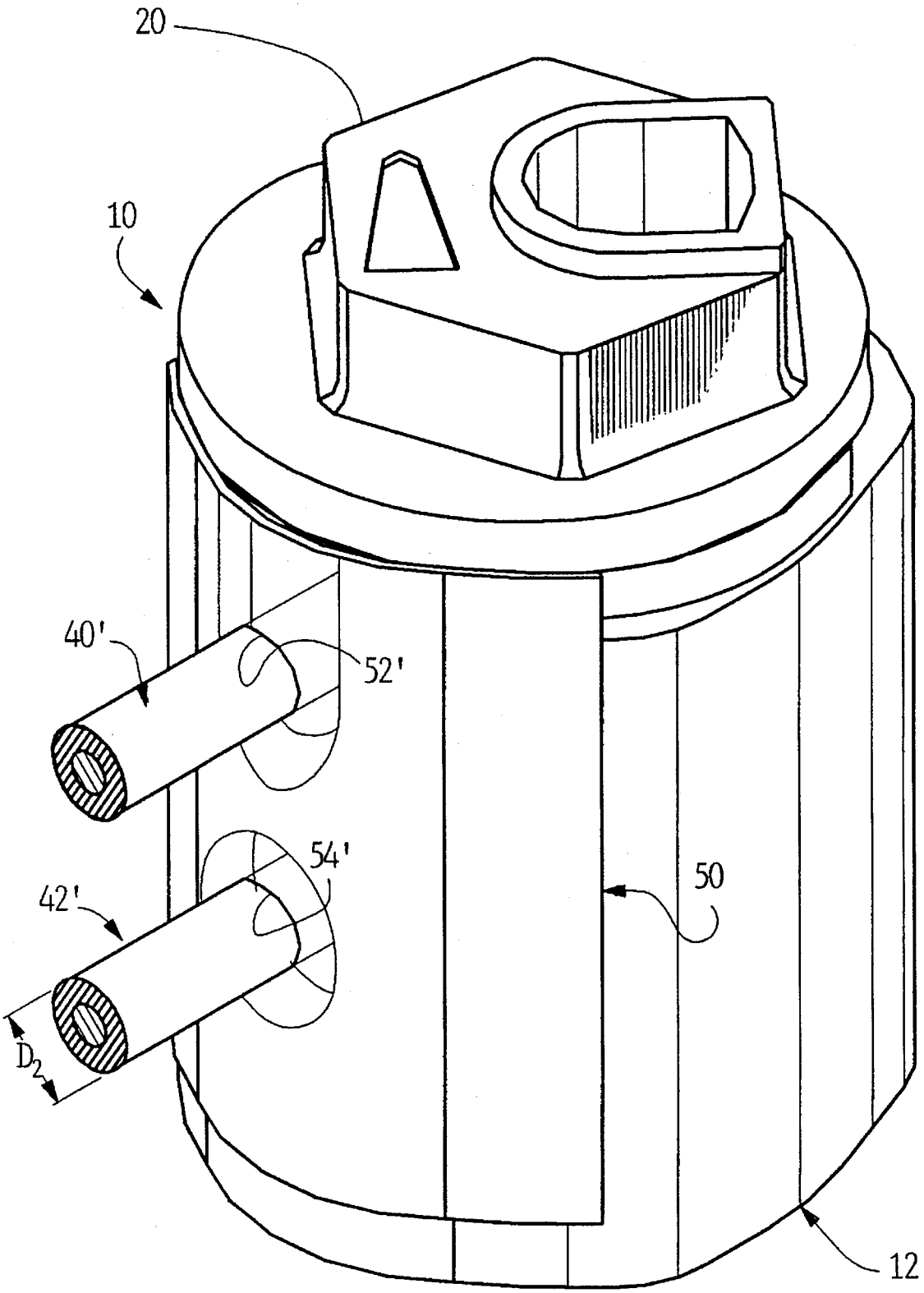
FIG. 3 is a view of the connector of FIG. 1 having ends of a pair of small-diameter wires after insertion through the tape holes and into the wire-receiving openings of the connector.

Connector 10 of FIGS. 1 to 3 includes a cylindrical housing section 12 of dielectric material, an actuator 20 secured thereto in a rotatable manner, two wire-receiving apertures 14,16 through a wall 18 of housing section 12, and a barrel-shaped terminal 30 disposed within housing section 12. Terminal 30 includes a wall section 32 through which are formed a pair of wire-receiving holes 34,36 aligned with wire-receiving apertures 14,16 of housing wall 18 when terminal 30 is angularly positioned in the unactuated or open state. Wire-terminating slots (not shown) extend laterally from a common side of wire-receiving holes 34,36 (to the right as seen in the Figures) such that when terminal 30 is rotated by relatively clockwise rotation of actuator 20 to its actuated or closed state following wire insertion, converging side edges at entrances of the slots cut into and penetrate the insulative outer jackets 44 of a wire 40,42;40',42' for the parallel side edges of the slots past the entrances to compress against and thus assuredly engage the conductors 46 within the insulative outer jackets for electrical termination thereto.

Figure 4:
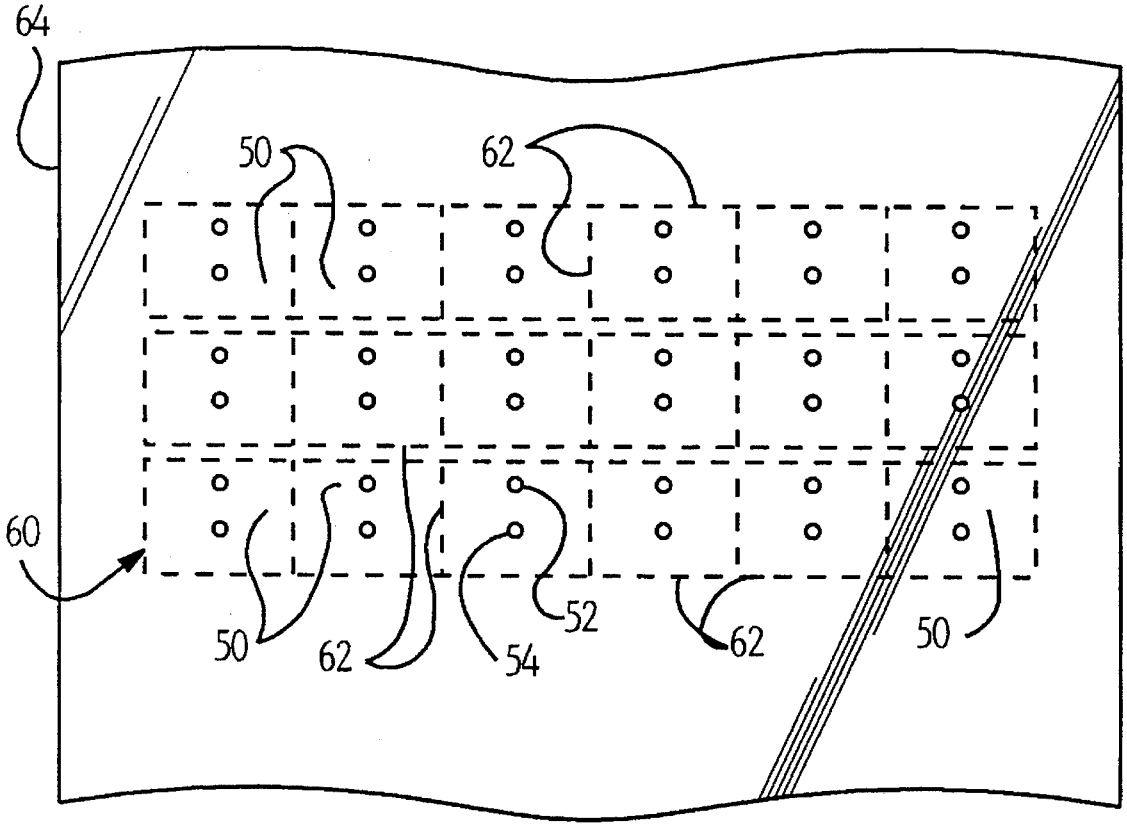
FIG. 4 is a plan view of a strip of several tape segments perforated to facilitate tearing of segments therefrom.

Tape segment or substrate 50 includes a pair of holes 52,54 punched thereinto which when tape segment 50 is properly positioned against the outer surface of housing section 12 and adhesively held thereto traversing the wire-receiving apertures 14,16, the wire-receiving holes 52,54 are substantially aligned with the centers of apertures 14,16 and also with wire-receiving holes 34,36 of terminal 30. Tape segment 50 may initially be integral with a several-segment tape strip 60 as seen in FIG. 4, and easily separable from adjacent segments by means of perforations 62, with the several-segment tape strips being initially joined to a continuous carrier strip 64 at perforations or may be severed therefrom to facilitate handling after punching of holes 52,54 and perforations 62. The material of tape strip 64 and each segment 50 is preferably a tough elastomeric substrate such as polyurethane such as for example SCOTCH polyurethane protective tape sold by 3M Industrial Specialties Division, St. Paul, Minn.; one especially useful type of such tape is identified as General Purpose, Outdoor Grade having Part No. 8672 and including a high performance acrylic adhesive backing.

Referring to FIGS. 2 and 3, tape segment 50 permits insertion of ends of insulated wires 40,42 having large diameters $D_1$ (which may have a somewhat D-shaped cross-section), or ends of insulated wires 40',42' having small diameters $D_2$. Wire-receiving holes 52,54 of tape segment 50 preferably have a diameter d which is selected to be smaller than $D_1$ or $D_2$. For example, $D_1$ may be about 0.180 inches for gage 18½, and $D_2$ may be about 0.100 inches for gage 24; hole diameter d could be about 0.090 inches for use with either gage wire.

As a wire end is inserted through a hole 52,54, the periphery of the punched hole is stretched by the larger diameter wire and permits insertion into the wire-receiving apertures and holes of the connector housing and terminal. The stretched diameter of the punched holes (52',54' in FIG. 3) now equates with the wire diameter, conforming tightly to the outer surface and must be tough to resist tearing as the wire is pushed therethrough. The material also resists tearing where the wire is of the type having a slight projecting ridge therealong for identification of a particular wire of two-conductor cable, where the extruded insulative jackets of two such wires are initially joined at a separable interface to define a two-conductor cable having "tip" and "ring" wires for telecommunications use.

The tight fit tends to retain the wire end in its fully inserted position prior to rotation of the actuator and terminal, resisting any tendency of the sealant material to eject the as-yet unterminated wire end outwardly at least partially, thus freeing the service personnel to perform actuation who otherwise face an awkward task of having to hold the wire end in position during termination. The tight fit remains thereafter, and during service and repair after termination permits the wire end to be withdrawn, again tightly gripping the wire insulative jacket and squeezing off the sealant tending to remain adhered to the jacket thus preventing any sealant material from being removed from the connector housing. The hole diameter reduces approximately to its original unstretched dimension due to elastomeric properties of the material, again retaining sealant material within the connector and awaiting wire end re-insertion.

An additional advantage is that during shipping of a sealant-filled connector prior to use, the tape with its small diameter holes assists in retaining the sealant material within the connector. Where curable sealant material is used, the practice of placing a continuous substrate across the apertures during curing of the sealant material may still be followed by placing such a substrate over the outward facing surface of the tape of the present invention, during manufacture of the connector whereafter the substrate would then be removed.

What is claimed is:

1. In a connector assembly of the type having a housing containing a terminal, and including at least one wire-receiving aperture permitting insertion of an end of at least one wire of known diameter thereinto for termination to the terminal, the connector assembly further containing sealant material therewithin for coating exposed metal surfaces for protecting the termination, the connector assembly also having a substrate disposed along and adhered to the outer surface thereof traversing the at least one wire-receiving aperture for assisting the retention of the sealant material therewithin, the substrate being of the type including a wire-receiving hole therein aligned with each respective at least one wire-receiving aperture, the improvement comprising:

said substrate being made of elastomeric material and having rugged durable construction highly resistant to tearing, and the diameter of each said wire-receiving hole selected to be less than the diameter of a said wire to be inserted thereinto for termination in said connector assembly, whereby the substrate material is stretchable without tearing during initial stages of wire end insertion for the diameter of said wire-receiving hole to be enlarged, whereafter the periphery of said wire-receiving hole tightly grips the outer surfaces of said wire during and after full wire end insertion as well as during withdrawal of said wire end to prevent incidental removal of said sealant material during service and repair of said connector assembly.

2. The connector assembly as set forth in claim 1, wherein said elastomeric material is polyurethane.

3. The connector assembly as set forth in claim 1, wherein the connector assembly includes two said wire-receiving apertures and said substrate includes two wire-receiving holes aligned with respective said wire-receiving apertures.

* * * * *